US010558136B2

(12) United States Patent
Furukawa et al.

(10) Patent No.: US 10,558,136 B2
(45) Date of Patent: Feb. 11, 2020

(54) CHARGING MEMBER, MANUFACTURING METHOD OF CHARGING MEMBER, ELECTROPHOTOGRAPHIC APPARATUS, AND PROCESS CARTRIDGE

(71) Applicant: CANON KABUSHIKI KAISHA, Tokyo (JP)

(72) Inventors: Takumi Furukawa, Susono (JP); Hiroaki Watanabe, Odawara (JP); Kenya Terada, Suntou-gun (JP); Yuya Tomomizu, Yokohama (JP); Toshimitsu Nakazawa, Isehara (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 16/372,834

(22) Filed: Apr. 2, 2019

(65) Prior Publication Data

US 2019/0324379 A1 Oct. 24, 2019

(30) Foreign Application Priority Data

Apr. 18, 2018 (JP) ..... 2018-079952
Feb. 26, 2019 (JP) ..... 2019-032936

(51) Int. Cl.
*G03G 15/02* (2006.01)

(52) U.S. Cl.
CPC ... *G03G 15/0233* (2013.01); *G03G 2215/021* (2013.01)

(58) Field of Classification Search
CPC ..... G03G 15/0233
USPC ..... 399/176
See application file for complete search history.

(56) References Cited

U.S. PATENT DOCUMENTS

| | | | |
|---|---|---|---|
| 3,640,708 | A | 2/1972 | Humphriss et al. |
| 5,198,685 | A | 3/1993 | Kitani et al. |
| 6,070,040 | A | 5/2000 | Goto et al. |
| 6,697,587 | B2 | 2/2004 | Harada |
| 7,693,457 | B2 | 4/2010 | Kuruma et al. |

(Continued)

FOREIGN PATENT DOCUMENTS

| | | | |
|---|---|---|---|
| EP | 1 385 176 | A | 1/2004 |
| EP | 3 306 409 | A | 4/2018 |

(Continued)

OTHER PUBLICATIONS

U.S. Appl. No. 16/196,106, Shuhei Iwasaki, filed Nov. 20, 2018.
U.S. Appl. No. 16/198,008, Tatsuya Yamai, filed Nov. 21, 2018.

*Primary Examiner* — William J Royer
(74) *Attorney, Agent, or Firm* — Venable LLP

(57) ABSTRACT

A charging member including an electro-conductive support; and an elastic layer, the elastic layer is a surface layer thereof and is constituted by a mono layer, the elastic layer includes domains and a matrix, an outer surface of the charging member is constituted by a surface of the matrix and surfaces of the domains, and the charging member has concave portions on the outer surface, the domains exist at bottom portions of the respective concave portions and are exposed to the outer surface of the charging member only at the bottom portions of the respective concave portions, the elastic layer has a volume resistivity of $1\times10^5$ Ωcm or more and $1\times10^8$ Ωcm or less, and A2 is 20 times or more of A1, wherein A1 and A2 are current values obtained by a prescribed method.

8 Claims, 9 Drawing Sheets

(56) References Cited

U.S. PATENT DOCUMENTS

| | | | | |
|---|---|---|---|---|
| 7,744,515 | B2 | 6/2010 | Iwamura et al. | |
| 7,962,068 | B2 | 6/2011 | Kuroda et al. | |
| 8,163,389 | B2 | 4/2012 | Hirakawa et al. | |
| 8,275,293 | B2 | 9/2012 | Ono | |
| 8,440,307 | B2 | 5/2013 | Nose et al. | |
| 8,445,113 | B2 | 5/2013 | Furukawa et al. | |
| 8,469,867 | B2 | 6/2013 | Kuroda et al. | |
| 8,481,167 | B2 | 7/2013 | Watanabe et al. | |
| 8,491,994 | B2 | 7/2013 | Harada et al. | |
| 8,501,312 | B2 | 8/2013 | Watanabe et al. | |
| 8,501,325 | B2 | 8/2013 | Tomomizu et al. | |
| 8,503,911 | B2 | 8/2013 | Suzumura et al. | |
| 8,526,857 | B2 | 9/2013 | Tomomizu et al. | |
| 8,532,535 | B2 | 9/2013 | Nose et al. | |
| 8,538,298 | B2 | 9/2013 | Harada et al. | |
| 8,622,881 | B1 | 1/2014 | Harada et al. | |
| 8,685,601 | B2 | 4/2014 | Nose et al. | |
| 8,750,762 | B2 | 6/2014 | Harada et al. | |
| 8,755,714 | B2 | 6/2014 | Nagamine et al. | |
| 8,923,732 | B2 | 12/2014 | Harada et al. | |
| 8,991,053 | B2 | 3/2015 | Watanabe et al. | |
| 9,274,442 | B2 | 3/2016 | Sato et al. | |
| 9,360,833 | B2 | 6/2016 | Terada et al. | |
| 9,372,428 | B2 | 6/2016 | Kuroda et al. | |
| 9,372,429 | B2 | 6/2016 | Watanabe et al. | |
| 9,645,517 | B2 * | 5/2017 | Sato et al. ..... | G03G 15/0233 |
| 9,904,199 | B2 | 2/2018 | Terada et al. | |
| 9,910,379 | B2 | 3/2018 | Furukawa et al. | |
| 9,939,750 | B2 * | 4/2018 | Narita et al. ..... | G03G 15/0233 |
| 10,012,924 | B2 | 7/2018 | Yoshidome et al. | |
| 10,146,149 | B2 | 12/2018 | Watanabe et al. | |
| 2012/0076535 | A1 | 3/2012 | Nagamine et al. | |
| 2012/0224887 | A1 | 9/2012 | Harada et al. | |
| 2012/0237863 | A1 | 9/2012 | Wu | |
| 2013/0004206 | A1 | 1/2013 | Kuroda et al. | |
| 2013/0034369 | A1 | 2/2013 | Masu et al. | |
| 2013/0064571 | A1 | 3/2013 | Kodama et al. | |
| 2013/0195517 | A1 | 8/2013 | Jansen et al. | |
| 2014/0219679 | A1 | 8/2014 | Liu et al. | |
| 2015/0087489 | A1 | 3/2015 | Sato et al. | |
| 2015/0277244 | A1 | 10/2015 | Sato et al. | |
| 2018/0101107 | A1 | 4/2018 | Tomomizu et al. | |
| 2018/0120727 | A1 | 5/2018 | Masu et al. | |

FOREIGN PATENT DOCUMENTS

| | | |
|---|---|---|
| JP | H02-206629 A | 8/1990 |
| JP | H09-279015 | 10/1997 |
| JP | H11-231637 | 8/1999 |
| JP | 2002-003651 | 1/2002 |
| JP | 2005-321764 | 11/2005 |
| JP | 2006-207807 | 8/2006 |
| JP | 2007-163849 | 6/2007 |
| JP | 2011-022410 | 2/2011 |
| JP | 2012-163954 | 8/2012 |
| JP | 2013-020175 | 1/2013 |
| JP | 2015-084010 | 4/2015 |
| JP | 2015-194746 | 11/2015 |
| JP | 2016-018154 | 2/2016 |
| JP | 2017-058639 | 3/2017 |
| JP | 2017-072833 | 4/2017 |

* cited by examiner

CHARGING MEMBER, MANUFACTURING METHOD OF CHARGING MEMBER, ELECTROPHOTOGRAPHIC APPARATUS, AND PROCESS CARTRIDGE

BACKGROUND

The present disclosure is directed to a charging member, a manufacturing method of a charging member, an electrophotographic apparatus, and a process cartridge.

DESCRIPTION OF THE RELATED ART

As a charging member for contact charging, Japanese Patent Application Laid-Open No. 2012-163954 discloses a charging member that includes a matrix containing ionic electro-conductive rubber and a domain formed of an electro-conductive rubber material containing rubber having a butadiene skeleton and carbon black and includes an elastic layer formed of an electro-conductive rubber elastic body, which is formed by modifying a terminal of the rubber having the butadiene skeleton at a specific atomic group.

SUMMARY

An aspect of the present disclosure is directed to providing a charging member capable of charging a member to be charged stably even in a case where a peripheral speed difference between a member to be charged and the charging member is large.

Another aspect of the present disclosure is directed to providing a manufacturing method of a charging member capable of charging a member to be charged stably even in a case where a peripheral speed difference between a member to be charged and the charging member is large.

Another aspect of the present disclosure is directed to providing an electrophotographic apparatus capable of forming a high-quality electrophotographic image.

Still another aspect of the present disclosure is directed to providing a process cartridge contributing to formation of a high-quality electrophotographic image.

According to an aspect of the present disclosure, there is provided a charging member including: an electro-conductive support; and an elastic layer, wherein the elastic layer is a surface layer of the charging member and is constituted by a mono layer, the elastic layer includes domains and a matrix, the domains each containing carbon black and rubber, the matrix containing rubber and having an electrical resistance higher than that of the domains, an outer surface of the charging member is constituted by a surface of the matrix and surfaces of the domains, and the charging member has concave portions on the outer surface, the domains exist at bottom portions of the respective concave portions and are exposed to the outer surface of the charging member only at the bottom portions of the respective concave portions, the elastic layer has a volume resistivity of $1\times10^5$ Ωcm or more and $1\times10^8$ Ωcm or less, and when A1 is defined as a current value at the time of applying a direct current (DC) voltage of 80 V between the electro-conductive support and a cantilever of an atomic force microscope (AFM) in contact with a surface of the matrix constituting the outer surface of the charging member and A2 is defined as a current value at the time of applying a DC voltage of 80 V between the electro-conductive support and a cantilever of an AFM in contact with surfaces of the respective domains constituting the outer surface of the charging member, A2 is 20 times or more of A1.

According to another aspect of the present disclosure, there is provided an electrophotographic apparatus including: an electrophotographic photosensitive member; and a charging member disposed to be capable of charging the electrophotographic photosensitive member, wherein the charging member is the charging member as described above.

According to still another aspect of the present disclosure, there is provided a process cartridge attachable to and detachable from a body of an electrophotographic apparatus and including: an electrophotographic photosensitive member; and a charging member disposed to be capable of charging the electrophotographic photosensitive member, wherein the charging member is the charging member as described above.

According to yet still another aspect of the present disclosure, there is provided a manufacturing method of a charging member, the charging member including an electro-conductive support and an elastic layer, the elastic layer being a surface layer of the charging member, being constituted by a mono layer, and including domains and a matrix, the domains each containing carbon black and rubber, the matrix containing rubber and having an electrical resistance higher than that of the domains, an outer surface of the charging member being constituted by surfaces of the matrix and a surface of the domains and having concave portions, and the domains existing at bottom portions of the respective concave portions and being exposed to the outer surface of the charging member only at the bottom portions of the respective concave portions, the manufacturing method of a charging member including:

(A) preparing a carbon master batch (CMB) for forming the domains, each containing carbon black and rubber;

(B) kneading the carbon master batch and a rubber composition that becomes the matrix to prepare a rubber composition having a domain-matrix structure; and (C) extruding the rubber composition having the domain-matrix structure together with a mandrel from a crosshead to cover the surrounding of the mandrel with the rubber composition having the domain-matrix structure, wherein when DS(d) is defined as a die swell value of the carbon master batch and DS(m) is defined as a die swell value of the rubber composition that becomes the matrix, a ratio between the die swell values DS(m)/DS(d) is greater than 1.0.

Further features of the present disclosure will become apparent from the following description of exemplary embodiments with reference to the attached drawings.

DESCRIPTION OF THE EMBODIMENTS

Figure 1A:
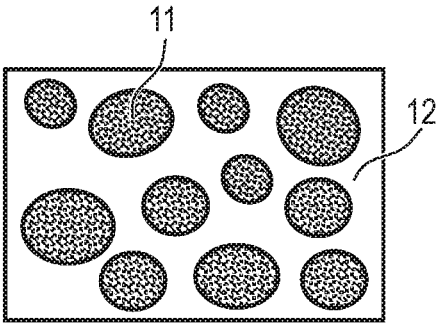
FIGS. 1A, 1B and 1C are schematic views showing a rubber composition having a domain-matrix structure.

We have confirmed that a charging member according to Japanese Patent Application Laid-Open No. 2012-163954 is effective for further reducing voltage dependency or ambient environment dependency of an electrical resistance of the charging member.

Meanwhile, in recent years, an electrophotographic image forming method that attempts to further suppress a stain of a charging member in an electrophotographic image forming step by independently driving the charging member and a member to be charged such as an electrophotographic photosensitive member disposed to be in contact with the charging member to increase a peripheral speed difference between the charging member and the member to be charged has been suggested.

However, in a case where the peripheral speed difference between the member to be charged and the charging member is increased, a surface potential of the member to be charged may not converge to a certain value.

We have examined the reason why the surface potential of the member to be charged does not converge to the constant value when the charging member according to Japanese Patent Application Laid-Open No. 2012-163954 is used for an electrophotographic image forming process in which the peripheral speed difference between the charging member and the member to be charged is large.

As a result, it is considered that the reason is that injection of electric charges from the charging member to the member to be charged is generated at a contact portion between the charging member and the member to be charged, in the electrophotographic image forming process. That is, it is considered that the reason is that as the electric charges are injected, the surface potential of the member to be charged does not converge to the constant value, and whenever the member to be charged rotates to rub against the charging member, the surface potential of the member to be charged is increased, such that the surface potential of the member to be charged is not stabilized.

Therefore, we have examined a configuration of the charging member capable of suppressing a phenomenon in which the electric charges are injected into the member to be charged due to contact between a domain of the charging member containing carbon black and the member to be charged.

As a result, we have found that a charging member having a configuration in which it is difficult for an electro-conductive domain to be in contact with the member to be charged is effective for achieving the above object.

That is, a charging member according to an aspect of the present disclosure includes an electro-conductive support and an elastic layer, wherein the elastic layer is a surface layer of the charging member, and is constituted by a mono layer, the elastic layer includes domains and a matrix, the domains each containing carbon black and rubber, the matrix containing rubber and having an electrical resistance higher than that of the domains.

An outer surface of the charging member is constituted by a surface of the matrix and surfaces of the domains, and the charging member has concave portions on the outer surface, and the domains exist at bottom portions of the respective concave portions and are exposed to the outer surface of the charging member only at the bottom portions of the respective concave portions.

The elastic layer has a volume resistivity of $1\times10^5$ Ωcm or more and $1\times10^8$ Ωcm or less.

In addition, when A1 is defined as a current value at the time of applying a direct current (DC) voltage of 80 V between the electro-conductive support and a cantilever of an atomic force microscope in contact with a surface of the matrix constituting the outer surface of the charging member and A2 is defined as a current value at the time of applying a DC voltage of 80 V between the electro-conductive support and a cantilever of an atomic force microscope in contact with surfaces of the respective domains constituting the outer surface of the charging member, A2 is 20 times or more of A1.

In the charging member according to the present aspect, the electric resistances of the domains and the matrix are set to have a predetermined ratio therebetween, and the domains exposed on the surface are set to be on the concave portions. As a result, carbon black, which is electro-conductive particles, exists in the concave portions of the domains, and movement of electric charges from the carbon black to the member to be charged at the contact portion between the charging member and the member to be charged can thus be prevented. In addition, in the charging member according to the present aspect, charging uniformity by discharge is also maintained as compared with a surface in which domains are covered with a matrix. The reason is that the domain that becomes a discharge point constitutes a part of the outer surface of the charging member.

Hereinafter, preferred embodiments of the present disclosure will be described. Hereinafter, particularly, a charging member (hereinafter, also referred to as a "charging roller") having a roller shape will be described as an example of a charging member, but a shape of the charging member according to the present disclosure is not limited to only the roller shape.

Figure 2:
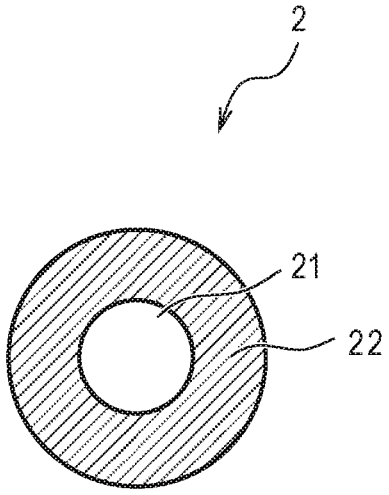
FIG. 2 is a schematic cross-sectional view showing a configuration of a charging roller.

FIG. 2 is a schematic view of a charging roller 2 as an example using an electro-conductive rubber elastic body according to the present aspect. The charging roller 2 includes a mandrel 21 and an elastic layer 22 provided on an outer circumference of the mandrel 21. This elastic layer 22 also serves as a surface layer in contact with a member to be charged.

Figure 1B:
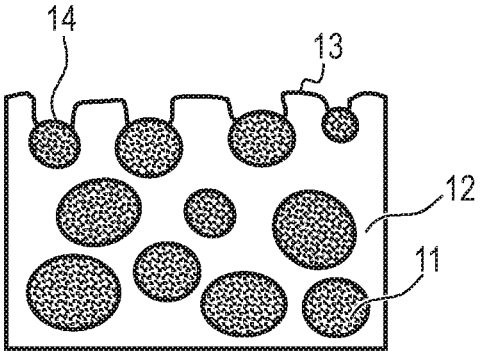
Figure 1C:
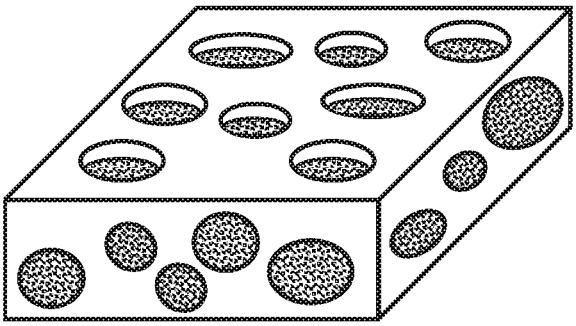

The elastic layer is configured in a domain-matrix structure including domains 11 each containing carbon black and rubber and a matrix 12 having an electrical resistance higher than that of the domains 11 and containing rubber, as shown in FIG. 1A. FIG. 1A is a cross-sectional view taken along a direction parallel to a face of the charging member in contact with the member to be charged. On the other hand, FIG. 1B is a cross-sectional view taken along a direction perpendicular to the face of the charging member in contact with the member to be charged. In FIG. 1B, a surface side of the charging member in contact with the member to be charged is denoted by reference numeral 13, and domains existing at bottom portions of respective concave portions existing in an outer surface of the charging member are denoted by reference numeral 14. FIG. 1C is an overhead view of the vicinity of the outer surface of the charging member. As shown in FIGS. 1A to 1C, the outer surface of the charging member according to the present disclosure is constituted by a surface of the matrix and surfaces of the domains, and the charging member has concave portions on the outer surface, and the domains are exposed only at the bottom portions of the respective concave portions.

The domains have a resistance lower than that of the matrix and contribute to electro-conductivity in the elastic layer or discharge to the member to be charged, and exist in the concave portions, such that injection of electric charges to the member to be charged is suppressed. In addition, since the matrix has a resistance higher than that of the domains, the matrix is in contact with the member to be charged, but an amount of electric charges injected into the member to be charged is small. Electrical characteristics for obtaining this effect are expressed by a volume resistance of the elastic layer and a ratio between current values of a domain portion and a matrix portion measured by an atomic force microscope (AFM).

That is, it is preferable that when A1 is defined as a current value at the time of applying a DC voltage of 80 V between an electro-conductive support and a cantilever of the AFM in contact with a surface of the matrix constituting an outer surface of the charging member and A2 is defined as a current value at the time of applying a DC voltage of 80 V between the electro-conductive support and a cantilever of the AFM in contact with surfaces of the domains constituting the outer surface of the charging member, A2 is 20 times or more of A1.

A current value flowing from the domain portion on a surface of the elastic layer is 20 times or more of the current value flowing from the matrix portion on the surface of the elastic layer on the assumption that the charging member has an appropriate volume resistance, such that injection of electric charges from the matrix portion to the member to be charged is suppressed and the member to be charged is charged by sufficient discharge from the domain portion.

A phenomenon in which a density of an electrophotographic image is changed in a process direction due to the fact that a surface potential of the member to be charged does not converge to a constant value or a phenomenon in which an image defect such as image unevenness is generated due to generation of a difference in injection of electric charges corresponding to stain unevenness of the charging member is prevented by suppressing the injection of the electric charges, such that stability of a potential of the charging member can be improved.

It is preferable that a volume fraction of the domains is 5 vol % or more and 25 vol % or less based on a volume of the elastic layer. When the volume fraction of the domains is 5 vol % or more, it is possible to obtain discharge required for the charging member without increasing electro-conductivity of the matrix. Meanwhile, when the volume fraction of the domains is 25 vol % or less, it is possible to suppress an increase in an injection potential due to connection and excessive approach between the domains. In addition, it is possible to suppress occurrence of overdischarge due to a decrease in a resistance. Further, it is more preferable that the volume fraction of the domains is 10 vol % or more and 20 vol % or less.

It is preferable that the number of domains in the elastic layer is preferably 1 or more and 500 or less in a piece of cube of 10 μm. By the way, in the number and the volume fraction of domains described above, a diameter of each of the domains is about 0.5 μm to 5 μm. The number of domains is 500 or less, such that it is possible to suppress an increase in an injection potential due to connection and excessive approach between the domains. In addition, it is possible to suppress occurrence of overdischarge due to a decrease in a resistance. Meanwhile, the number of domains is 1 or more, such that it is necessary to increase electro-conductivity of the matrix due to a small number of domains and it is possible to suppress the injection potential from being increased. In addition, it is possible to suppress occurrence of insufficient discharge due to an increase in a resistance.

It is preferable that a depth of the concave portion having the bottom portion on which the domain is exposed is 1.0 μm or more and 4.0 μm or less. The depth of the concave portion is 1.0 μm or more, such that contact between the domain and the member to be charged in a state in which the charging member abuts against the member to be charged is suppressed, which is preferable. Meanwhile, the depth of the concave portion is 4.0 μm or less, such that even in a case where a stain is attached to the concave portion, it is possible to electrostatically return the stain to the member to be charged.

(Material of Elastic Layer)

The domain is formed of an electro-conductive rubber material. The electro-conductive rubber material includes, for example, a rubber material of which an electrical resistance is adjusted by dispersing carbon black in a binder polymer that does not show electro-conductivity in itself.

As the binder polymer, a rubber composition containing butadiene rubber, acrylonitrile butadiene rubber, isoprene rubber, chloroprene rubber, styrene-butadiene rubber, ethylene-propylene rubber, polynorbornene rubber, and epichlorohydrin rubber conventionally used for an electro-conductive elastic layer of a charging member, for example, an electro-conductive elastic layer of a charging roller for an electrophotographic apparatus is appropriately used.

A type of carbon black compounded in the domain is not particularly limited as long as it is an electro-conductive carbon black that can impart electro-conductivity to the domain. A specific example of the carbon black compounded in the domain includes gas furnace black, oil furnace black, thermal black, lamp black, acetylene black, ketjen black and the like.

Further, a filler, a processing aid, a crosslinking aid, a crosslinking accelerator, a crosslinking acceleration aid, a crosslinking retardant, a softening agent, a dispersing agent, a coloring agent and the like which are generally used as compounding agents of rubber may be added to the rubber composition forming the domain, if necessary.

The matrix does not contain electro-conductive particles such as the carbon black, and has an electrical resistance higher than that of the domain. As a binder polymer contained in the matrix, a rubber composition containing butadiene rubber, isoprene rubber, chloroprene rubber, styrene-butadiene rubber, ethylene-propylene rubber, polynorbornene rubber, and epichlorohydrin rubber conventionally used for an electro-conductive elastic layer of a charging member, for example, an electro-conductive elastic layer of a charging roller for an electrophotographic apparatus is appropriately used.

An ionic electro-conductive agent may be compounded with the rubber composition constituting the matrix described above as much as it does not bleed out in order to adjust a resistance of the elastic layer to a medium resistance (for example, $1.0\times10^5\Omega$ to $1.0\times10^8\Omega$) appropriate for the charging member. However, in the matrix in which the ionic electro-conductive agent is compounded, injection of electric charges tends to be increased, and it is thus preferable to compound the ionic electro-conductive agent as small as possible.

Examples of such an ionic electro-conductive agent can include inorganic ionic substances such as lithium perchlorate, sodium perchlorate, and calcium perchlorate; cationic surfactants such as lauryl trimethyl ammonium chloride, stearyl trimethyl ammonium chloride, octadecyl trimethyl ammonium chloride, dodecyl trimethyl ammonium chloride, hexadecyl trimethyl ammonium chloride, trioctyl propyl ammonium bromide, and modified aliphatic dimethylethyl ammonium ethosulfate; amphoteric surfactants such as lauryl betaine, stearyl betaine, and dimethyl alkyl lauryl betaine; quaternary ammonium salts such as tetraethyl ammonium perchlorate, tetrabutyl ammonium perchlorate, and trimethyl octadecyl ammonium perchlorate; and organic acid lithium salts such as lithium trifluoromethanesulfonate.

A compounding amount of ionic electro-conductive agent as described above is, for example, 0.5 parts by mass or more and 5.0 parts by mass or less with respect to 100 parts by mass of the rubber composition.

In addition, for example, a spherical particle having a particle diameter in a range of 1 μm to 90 μm may be added to the rubber composition forming the matrix. A specific example of such a spherical particle can include at least one spherical particle selected from a phenol resin particle, a silicone resin particle, a polyacrylonitrile resin particle, a polystyrene resin particle, a polyurethane resin particle, a nylon resin particle, a polyethylene resin particle, a polypropylene resin particle, an acrylic resin particle, a silica particles, and an alumina particle. By using such a rubber composition, a charging member in which an outer surface of the elastic layer has a convex portion derived from the spherical particle can be formed.

Figure 9:
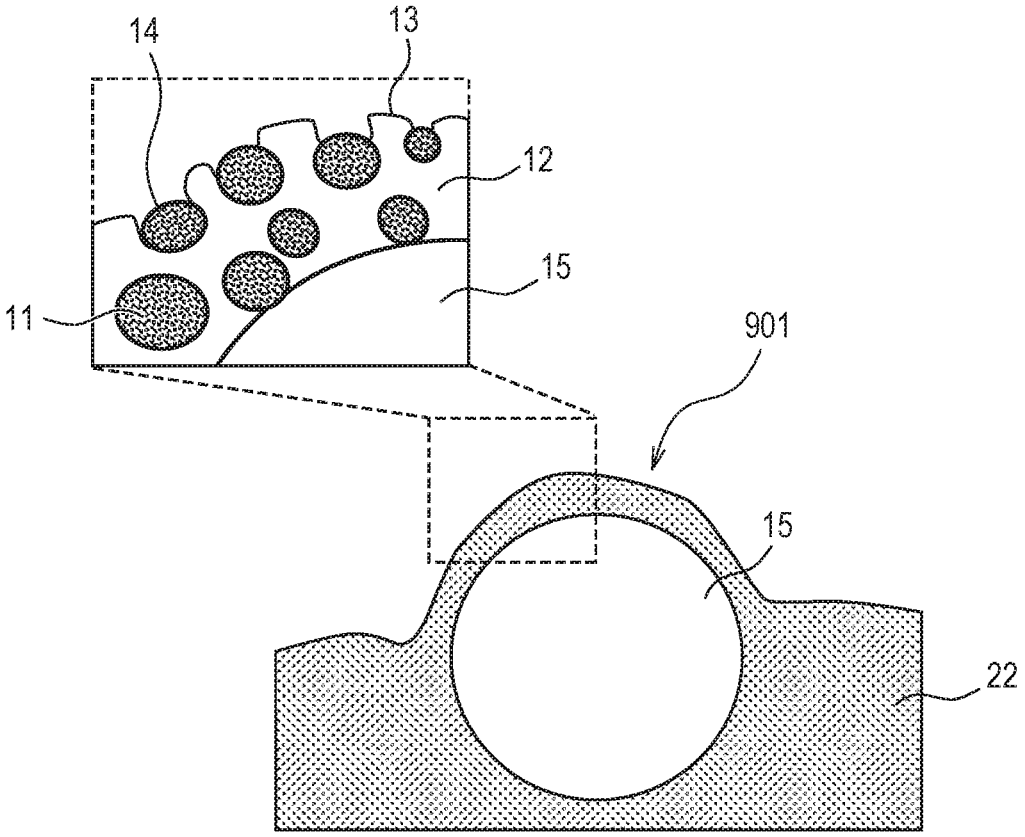
FIG. 9 is a schematic view showing a rubber composition (containing spherical resin particles) having a domain-matrix structure.

FIG. 9 is a view for describing a charging member according to an aspect the present disclosure in which the elastic layer 22 includes a spherical particle 15 and an outer surface of the elastic layer 22 has a convex portion derived from the spherical particle 15. Specifically, FIG. 9 is a cross-sectional view when a portion at which a convex portion 901 derived from the spherical particle 15 of the elastic layer 22 is formed is cut in a thickness direction of the elastic layer and a partially enlarged view of an outer surface of the convex portion 901. As shown in FIG. 9, the outer surface of the convex portion 901 derived from the spherical particle 15 has concave portions, and domains 11 are exposed only at bottom portions of the respective concave portions. For this reason, even though the convex portion 901 derived from the spherical particle 15 exists on the outer surface, it is difficult for electro-conductive domains to be in direct contact with a member to be charged (not shown). For this reason, injection of electric charges from the charging member to the member to be charged is significantly suppressed, and as a result, a charged potential of the member to be charged is further stabilized.

In general, when an incompatible polymer blend is used as a material of the elastic layer, a domain-matrix structure thereof depends on a viscosity of each polymer or a blending condition, but a rubber composition having a large composition ratio and a rubber composition having a low viscosity tend to become a matrix. Therefore, a volume fraction of the domains needs to be 5 vol% or more and 25 vol% or less. As a result, it is possible to form stable domains, such that the domain-matrix structure of the entire electro-conductive rubber composition is stabilized.

Further, in order to allow a stable domain-matrix structure to appear, it is preferable that at a value of ML 1 +4 at 100° C. using a Mooney viscometer, a viscosity of the domain is higher than that of the matrix, and a viscosity difference between the domain and the matrix is 5 points or more and 60 points or less.

(Electro-conductive Support)

An electro-conductive support may be any electro-conductive support that has electro-conductivity, is capable of supporting a surface layer and the like, and is capable of maintaining strength of a charging member, typically, a charging roller.

<Manufacturing Method of Charging Member>

As an example of a manufacturing method of a charging member according to an aspect of the present disclosure, a method effective in that a manufacturing step is simple will be described. The manufacturing method includes the following steps (A) to (D):

(A) a step of preparing a carbon master batch (CMB) for forming domains, each containing carbon black and rubber;

(B) a step of preparing a rubber composition that becomes a matrix;

(C) a step of kneading the carbon master batch and the rubber composition to prepare a rubber composition having a domain-matrix structure; and (D) a step of extruding the rubber composition having the domain-matrix structure together with a mandrel from a crosshead to cover the surrounding of the mandrel with the rubber composition having the domain-matrix structure.

Figure 3:
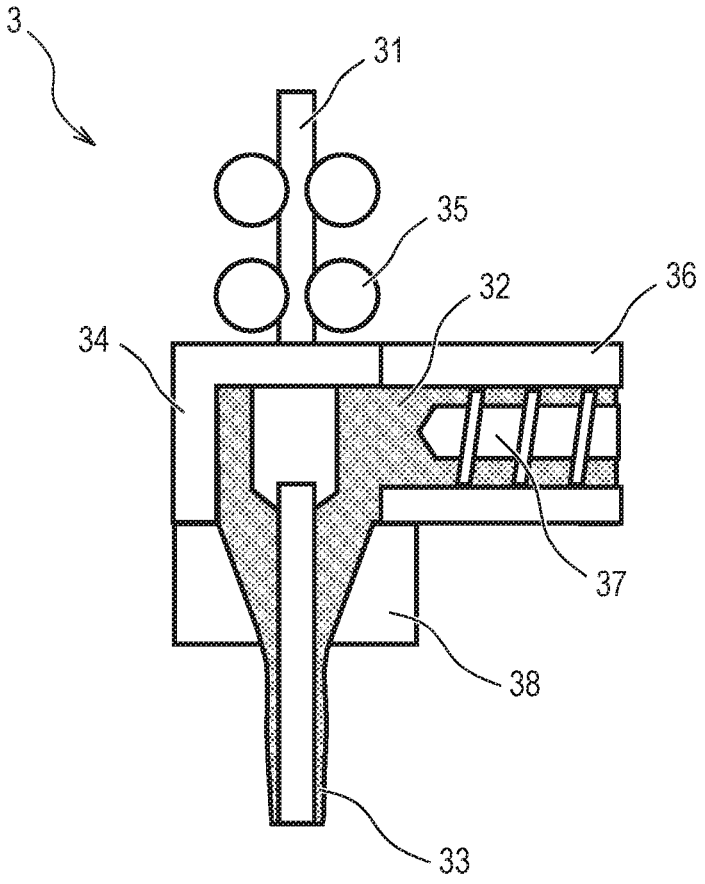
FIG. 3 is a view showing a schematic configuration of a crosshead extruding apparatus.

FIG. 3 is a view showing a schematic configuration of a crosshead extruder 3. The crosshead extruder 3 is an apparatus for evenly covering an unvulcanized rubber composition 32 over the entire periphery of a mandrel 31 to manufacture an unvulcanized rubber roller 33 having the mandrel 31 positioned in the center thereof.

The crosshead extruder 3 is provided with a crosshead 34 into which the mandrel 31 and the unvulcanized rubber composition 32 are fed, a conveying roller 35 which feeds the mandrel 31 into the crosshead 34, and a cylinder 36 which feeds the unvulcanized rubber composition 32 into the crosshead 34.

The conveying roller 35 continuously feeds mandrels 31 into the crosshead 34 in an axial direction. The cylinder 36 has a screw 37 formed therein, and the unvulcanized rubber composition 32 is fed into the crosshead 34 by rotation of the screw 37.

When the mandrel 31 is fed into the crosshead 34, the entire periphery of the mandrel 31 is covered with the unvulcanized rubber composition 32 fed from the cylinder 36 into the crosshead 34. Then, the mandrel 31 is fed out as the unvulcanized rubber roller 33 of which a surface is covered with the unvulcanized rubber composition 32, from a die 38 of an outlet of the crosshead 34.

Here, when DS(d) is defined as a die swell value of the carbon master batch prepared in step (A) and DS(m) is defined as a die swell value of the rubber composition prepared in step (B), DS(m)/DS(d) is greater than 1.0. Therefore, it is possible to form the charging member according to the present aspect.

The die swell value will be described. When rubber is extruded using an extruder of a die, in the extruder, the rubber compressed due to application of a pressure is extruded from an extrusion port, such that the pressure is released, and the extruded rubber is thus swollen. Therefore, a thickness of the swollen rubber is larger than a size of a gap of the extrusion port of the die. The die swell value is an index indicating a degree of expansion of the rubber when the rubber is extruded from the extrusion port.

In the manufacturing method of a charging member according to the present aspect, the carbon master batch for forming domains and the rubber composition for forming a matrix that satisfy a relationship DS(m)/DS(d) >1.0 are mixed with each other to prepare a rubber composition having a domain-matrix structure. Then, the rubber composition having the domain-matrix structure is extruded from the extrusion port of the crosshead while being swollen. In this case, since a swelling coefficient of the matrix is larger than that of the domain, the matrix of the surroundings of the domains existing on a surface of the extruded rubber layer is swollen. As a result, a layer of an unvulcanized rubber composition having concave portions formed in a surface thereof and having domains existing at bottom portions of the respective concave portions is formed. It is preferable that DS(m)/DS(d) is 1.1 or more in order to more easily form a structure of a surface layer according to the present aspect.

The die swell values of the carbon master batch for forming domains and the rubber composition for forming a matrix can be adjusted by, for example, a type and an amount of added filler. Specifically, the die swell values are decreased as the amount of added filler is increased. In addition, the die swell values are smaller in a case where a filler having a high reinforcing effect on rubber, such as carbon black or silica, or a scaly filler such as bentonite or graphite is used as the filler than in a case where calcium carbonate is used as the filler.

In step (C), an example of a method of kneading the CMB that becomes the domain and the unvulcanized rubber composition that becomes the matrix to prepare the unvulcanized rubber composition having the domain-matrix structure can include methods described in the following (i) and (ii):

(i) a method of mixing each of the CMB that becomes the domain and the unvulcanized rubber composition that becomes the matrix using a close-type mixer such as a Banbury mixer or a pressurized kneader and then kneading and integrating the CMB that becomes the domain, the unvulcanized rubber composition that becomes the matrix, and a raw material such as a vulcanizing agent or a vulcanization accelerator with one another using an open-type mixer such as an open roll; and (ii) a method of mixing the CMB that becomes the domain using a close-type mixer such as a Banbury mixer or a pressurized kneader, mixing the CMB that becomes the domain and a raw material of the unvulcanized rubber composition that becomes the matrix with each other in the close-type mixer, and then kneading and integrating the CMB, the raw material of the unvulcanized rubber composition, and a raw material such as a vulcanizing agent or a vulcanization accelerator with each other using an open-type mixer such as an open roll.

The layer of the unvulcanized rubber composition having the concave portions formed in the surface thereof and having the domains existing at the bottom portions of the respective concave portions in step (D) can then be subjected to a vulcanization step as step (E) to become a surface layer according to the present aspect. Specific examples of a heating method can include hot blast store heating by a gear oven, heating vulcanization with far infrared rays, steam heating by a vulcanizing can, and the like. Among them, the blast store heating or the far infrared ray heating is preferable because it is suitable for continuous production.

It is preferable that polishing is not performed on a surface of the obtained charging roller in order to better maintain a surface shape in which the domains exist at the bottom portions of the respective concave portions formed by the method described above. Therefore, in a case where an outer shape of the elastic layer of the charging roller according to the present aspect is a crown shape, it is preferable to mold an outer diameter shape of the unvulcanized rubber layer in a crown shape by controlling an extrusion speed of the mandrel and an extrusion speed of the unvulcanized rubber composition from the crosshead. It should be noted that the crown shape refers to a shape in which an outer diameter of a central portion of the mandrel of the elastic layer in a longitudinal direction is larger than that of an end portion of the mandrel.

Specifically, a relative ratio between a feeding speed of the mandrel 31 by the conveying roller 35 and a feeding speed of the unvulcanized rubber composition 32 from the cylinder 36 is changed. In this case, a feeding speed of the unvulcanized rubber composition 32 from the cylinder 36 to the crosshead 34 is set to be constant. A thickness of the unvulcanized rubber composition 32 is determined by the ratio between the feeding speed of the mandrel 31 and the feeding speed of the unvulcanized rubber composition 32. As a result, it is possible to form the elastic layer in the crown shape without performing the polishing.

Vulcanized rubber compositions of both end portions of a vulcanized rubber roller are removed in the subsequent separate step, such that the vulcanized rubber roller is completed. Therefore, in the completed vulcanized rubber roller, both end portions of the mandrel are exposed. The surface layer may be subjected to surface treatment by irradiating the surface layer with ultraviolet rays or an electron beam.

(Electrophotographic Apparatus)

The charging member according to the aspect of the present disclosure can be used for an electrophotographic apparatus such as a laser printer and a process cartridge attachable to and detachable from the electrophotographic apparatus.

Figure 7:
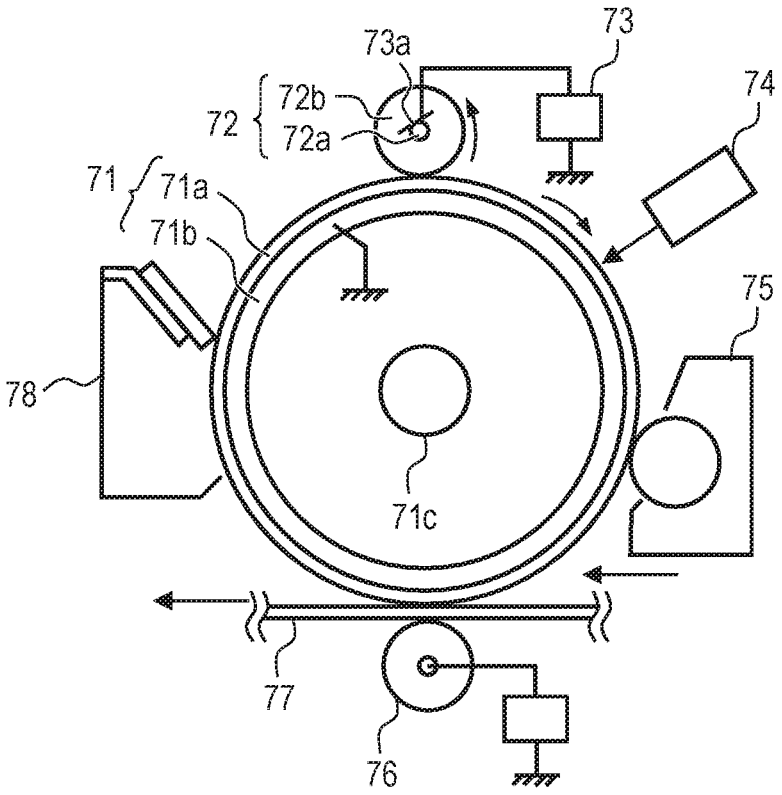
FIG. 7 is a view showing a configuration of an electrophotographic apparatus.

In FIG. 7, a schematic cross-sectional view of an electrophotographic apparatus according to an aspect of the present disclosure is shown. An electrophotographic photosensitive member (hereinafter, referred to as a "photosensitive member") 71 as a member to be charged includes an electro-conductive support 71*b* and a photosensitive layer 71*a* formed on the electro-conductive support 71*b*, and has a cylindrical shape. The photosensitive member is driven around a shaft 71*c* in a clockwise direction in FIG. 7 with a predetermined peripheral speed.

A charging roller 72 is disposed in contact with the photosensitive member 71 to charge the photosensitive member 71 with a predetermined potential. The charging roller 72 includes a mandrel 72*a* and an elastic layer 72*b* formed on the mandrel 72*a*. Both end portions of the mandrel 72*a* are pressed against the photosensitive member 71 by a pressing unit (not shown), such that the charging roller 72 is driven and rotated in accordance with rotation of the photosensitive member 71. A predetermined DC voltage is applied to the mandrel 72*a* from a power supply 73 by a slide-rubbing electrode 73*a*, such that the photosensitive member 71 is charged with a predetermined potential.

Then, electrostatic latent images corresponding to target image information are formed on a peripheral surface of the charged photosensitive member 71 by an exposure unit 74. Then, the electrostatic latent images are sequentially visualized as toner images by a developing member 75. The toner images are sequentially transferred onto transfer materials 77. The transfer material 77 is conveyed to a transfer portion between photosensitive member 71 and a transfer unit 76 at an appropriate timing in synchronization with the rotation of the photosensitive member 71 from a paper feeding unit (not shown). The transfer unit 76 is a transfer roller, and charging is performed with a polarity opposite to that of a toner from the back of the transfer material 77, such that the toner image on the photosensitive member 71 is transferred to the transfer material 77. The transfer material 77 subjected to the transfer of the toner image to a surface thereof is separated from the photosensitive member 71, is conveyed to a fixing unit (not shown), the toner is fixed to the transfer material 77, and the transfer material 77 to which the toner is fixed is output as an image formed product. On the peripheral surface of the photosensitive member 71 after the image is transferred, the toner or the like remaining on the surface of the photosensitive member 71 is removed by a cleaning member 78 represented by an elastic blade. The cleaned peripheral surface of the photosensitive member 71 moves to an electrophotographic image forming process of the next cycle.

The charging member (charging roller) according to the aspect of the present disclosure can be appropriately used even in a case where a peripheral speed difference between the member to be charged and the charging member is large, such as a case where an outer diameter difference between a central portion and an end portion of the crown shape increases due to an increase in deflection of the charging roller depending on a decrease in a diameter or a case where the charging roller and the member to be charged are independently driven to provide a peripheral speed difference between the charging roller and the member to be charged and a stain of the charging roller is prevented by slide-rubbing.

<Process Cartridge>

Figure 8:
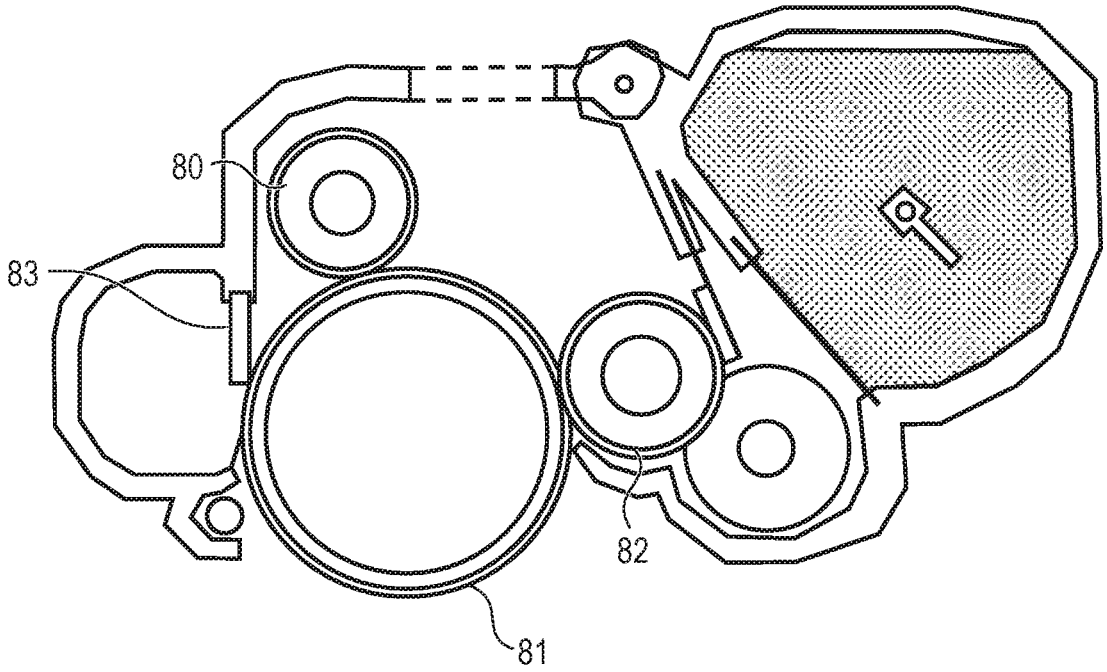
FIG. 8 is a view showing a configuration of a process cartridge.

A process cartridge according to an aspect of the present disclosure is shown in FIG. 8. The process cartridge is attachable to and detachable from the electrophotographic apparatus. The process cartridge includes an electrophotographic photosensitive member 81, a charging roller 80 disposed to be capable of charging the electrophotographic photosensitive member 81, a developing roller 82, and a cleaning member 83. The charging member according to the aspect of the present disclosure is used as the charging roller 80.

According to an aspect of the present disclosure, it is possible to obtain a charging member having a high potential stability even in a case where the peripheral speed difference between the member to be charged and the charging member is large.

In addition, according to another aspect of the present disclosure, it is possible to obtain a manufacturing method of a charging member having a high potential stability even in a case where a peripheral speed difference between a member to be charged and the charging member is large. Further, according to still another aspect of the present disclosure, it is possible to obtain an electrophotographic apparatus capable of forming a high-quality electrophotographic image. Furthermore, according to yet still another aspect of the present disclosure, it is possible to obtain a process cartridge contributing to formation of a high-quality electrophotographic image.

EXAMPLE

Example 1

<Preparation of Carbon Master Batch (CMB) 1>

A CMB 1 was prepared by mixing a carbon master batch (CMB) raw material listed in Table 1 in compounding amounts shown in Table 1. As a mixer, a 6 liter pressure kneader (product name: TD6-15MDX, manufactured by Tosin Co.) was used. As mixing conditions, a packing factor was 70 vol %, revolutions per minute of a blade were 30 rpm, and a mixing time was 16 minutes.

TABLE 1

| Material (Trade Name, Manufacturer) | Compounding Amount (part) |
|---|---|
| SBR (Tufdene 2003, Asahi Chemical Industry Co., Ltd.) | 15 |
| Carbon Black (Tokai Black #5500, Tokai Carbon Co., Ltd.) | 12 |
| Zinc Oxide | 0.75 |
| Zinc Stearate | 0.15 |

<Calculation of Die Swell of CMB>

A die swell value (DS(d)) of the CMB 1 prepared as described above was calculated by the following method.

That is, measurement of the die swell is performed according to JISK 7199: 1999 using a capillary rheometer (trade name: Capilograph 1D type, manufactured by Toyo Seiki Co., Ltd.).

The measurement was performed at a capillary length of 10 mm, a capillary diameter D of 2 mm, a furnace body diameter of 9.55 mm, a load cell type of 20 kN, a measurement temperature of 80° C. For the die swell, a diameter R [mm] of a extruded strand at a piston speed of 100 mm/min (shear rate of $1.52\times10^2$) was measured and calculated as a die swell DS=R/D.

<Calculation of Die Swell Value of Raw Material 1 for Forming A Kneaded Rubber Composition>

Materials listed in Table 2 were prepared as raw materials of an A kneaded rubber composition.

These materials were mixed with each other in compounding amounts listed in Table 2. As a mixer, a 6 liter pressure kneader (product name: TD6-15MDX, manufactured by Tosin Co.) was used. As mixing conditions, a packing factor was 70 vol %, revolutions per minute of a blade were 30 rpm, and a mixing time was 16 minutes. A die swell value (DS(m)) of an obtained mixture was calculated in the same manner as the method of calculating a die swell of a CMB.

TABLE 2

| Material (Trade Name, Manufacturer) | Compounding Amount (part) |
|---|---|
| NBR (N230SL, JSR Co., Ltd.) | 85 |
| Zinc Oxide | 4.25 |
| Zinc Stearate | 0.85 |
| Calcium Carbonate (Super#1700, Maruo Calcium Co., Ltd.) | 21.25 |

<Preparation of Unvulcanized Rubber Composition 1>

An A kneaded rubber composition was obtained by adding and kneading the raw materials shown in Table 2 to the above CMB 1. As a mixer, a 6 liter pressure kneader (product name: TD6-15MDX, manufactured by Tosin Co.) was used. As mixing conditions, a packing factor was 70 vol %, revolutions per minute of a blade were 30 rpm, and a mixing time was 16 minutes.

An unvulcanized rubber composition 1 as a B kneaded rubber composition was obtained by adding and further kneading raw materials shown in Table 3 to the obtained A kneaded rubber composition. As a mixer, an open roll having a roll diameter of 12 inches (0.30 m) was used. After rolling was repeatedly performed leftward and rightward a total of twenty times under mixing conditions in which revolutions per minute of a front roll were 10 rpm, revolutions per minute of a rear roll were 8 rpm, a roll clearance was 2 mm, tight milling was performed ten times with a roll clearance of 0.5 mm.

TABLE 3

| Material (Trade Name, Manufacturer) | Compounding Amount (part) |
|---|---|
| Sulfur | 1 |
| Vulcanization Accelerator 1 (Nocceler TS, Ouchi Shinko Chemical Industry Co., Ltd.) | 1 |
| Vulcanization Accelerator 2 (Nocceler DM, Ouchi Shinko Chemical Industrial Co., Ltd.) | 1 |

(Calculation of Volume Fraction of CMB 1)

A volume fraction of the CMB 1 was calculated according to the following calculation formula (1) from a specific gravity and a compounding mass part of the CMB 1 and a specific gravity and a compounding mass part of the unvulcanized rubber composition 1.

Volume Fraction (%) of CMB 1=((Compounding Mass Part of CMB 1)/(Specific Gravity of CMB 1))/((Mass part of Unvulcanized Rubber Composition 1)/(Specific Gravity of Unvulcanized Rubber Composition 1))×100 Calculation Formula (1)

For measurement of the specific gravity, an electronic specific gravity meter (trade name: EW-300SG; manufactured by Alpha Mirage Co.) was used. In addition, for measurement of the specific gravity, three specimens for measurement (having a length of 1 cm, a width of 1 cm, and a thickness of 2 mm) were prepared from the CMB 1 and the unvulcanized rubber composition 1, respectively, specific gravities were measured using the respective measurement specimens, and average values of obtained results were used as specific gravities of the CMB 1 and the unvulcanized rubber composition 1 in the above calculation.

(Molding of Vulcanized Rubber Layer)

First, in order to obtain a mandrel having an adhesive layer for adhering a vulcanized rubber layer, the following operation was performed. That is, an electro-conductive vulcanized adhesive (trade name: Metalloc U-20; manufactured by Toyo Chemical Institute) was applied to a central portion 222 mm, in an axial direction, of a cylindrical electro-conductive mandrel (formed of steel and having a surface placed with nickel) having a diameter of 6 mm and a length of 252 mm, and was then dried at 80° C. for 30 minutes.

The unvulcanized rubber composition 1 prepared as described above was coated on the mandrel having this adhesive layer by a crosshead extruder to obtain a unvulcanized rubber roller having a crown shape. A molding temperature was set to 100° C., revolutions per minute of a screw were set to 10 rpm, and molding was performed while changing a feeding speed of the mandrel. An inner diameter of a die of the crosshead extruder was 8.4 mm, while molding was performed so that the unvulcanized rubber roller becomes thick, such that an outer diameter of the center of the unvulcanized rubber roller in the axial direction was 8.6 mm and an outer diameter of an end portion of the unvulcanized rubber roller in the axial direction was 8.5 mm.

Then, the unvulcanized rubber roller was heated in an electric furnace at a temperature of 160° C. for 40 minutes to vulcanize a layer of the unvulcanized rubber composition 1, thereby obtaining a vulcanized rubber layer. Both end portions of the vulcanized rubber layer were cut to obtain a vulcanized rubber roller of which a length in the axial direction is 232 mm.

(Irradiation of Electron Beam to Vulcanized Rubber Layer after Extrusion)

An electron beam was irradiated to a surface of the obtained vulcanized rubber roller to obtain a charging roller 1 having a cured region on a surface of an elastic layer (surface layer). An electron beam irradiation apparatus (manufactured by Iwasaki Electric Co., Ltd.) having a maximum acceleration voltage of 150 kV and a maximum electron current of 40 mA was used for the irradiation of the electron beam, and nitrogen was filled at the time of irradiating the electron beam. As irradiation conditions of the electron beam, an accelerating voltage was 150 kV, an electron current was 35 mA, a dose was 1323 kGy, a processing speed was 1 m/min, and an oxygen concentration was 100 ppm.

(Confirmation of Whether or not Domains Exist and Measurement of Number of Domains)

A section of the elastic layer having a thickness of 1 mm was cut from the charging roller. This section was immersed in an aqueous solution of 5% phosphotungstic acid for 15 minutes, and was then taken out, washed with pure water, and further dried at room temperature (25° C.). A matrix domain domain-matrix structure of the stained section obtained in this way was observed using a focused ion beam-scanning electron microscope (FIB-SEM). Specifically, an FIB-SEM (trade name: Dual Beam SEM Helios 600, manufactured by FEI Co.) was used. A specific measurement method is described below.

A blade of a cutter was disposed perpendicular to a surface of the charging roller to cut out a section of a 1 mm square in an x axis direction (longitudinal direction of the charging roller) and a y axis direction (tangential direction of a circular cross section in a transverse cross section of the charging roller orthogonal to an x axis). The cut section was observed from a z direction (direction normal to a surface of the charging roller orthogonal to an xy plane) at an acceleration voltage of 10 kV and a magnification of 1000 using an FIB-SEM apparatus. Then, a total of 100 cross-sectional images were captured up to a depth of 10 μm from the surface at intervals of 100 nm in a z direction in an ion beam current amount of 20 nA using a gallium ion beam. Whether or not a domain-matrix structure exists was confirmed and the number of domains was counted, from a three-dimensional image obtained by performing three-dimensional reconstruction from this cross-sectional image. At the time of counting the number of domains, domains of which parts exist at a boundary of the image were excluded, and the number of domains in which a diameter of a true sphere corresponding to a volume of the domain is 200 μm or more was counted.

(Volume Resistivity)

The elastic layer of the charging roller was cut with a razor to obtain a section of a semi-cylindrical rubber. A volume resistivity of a cut surface of this rubber was measured by a 4-terminal 4-probe method. As conditions of the measurement, a resistivity meter (trade name: Loresta GP, manufactured by Mitsubishi Chemical Analytech Co.) was used, and an applied voltage was 90 V, a load was 10 N, a distance between pins was 1.0 mm, a pin tip was 0.04 R, and a spring pressure was 250 g, under an environment of 23° C./50% RH (relative humidity). The volume resistivity was $4.7\times10^5$ Ωcm.

(Measurement of Depth of Concave Portion and Current Value by AFM)

Figure 4:
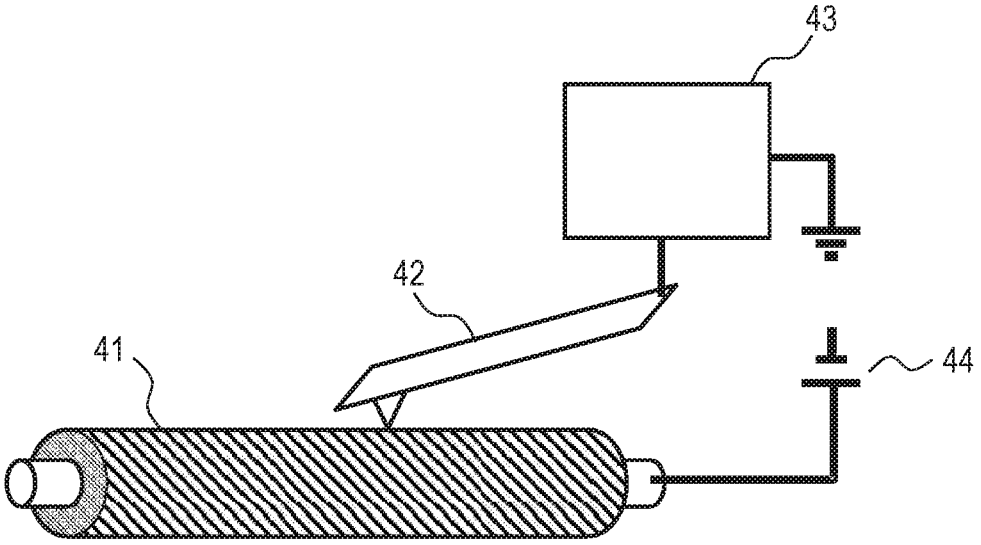
FIG. 4 is a view showing a schematic configuration of an apparatus that measures a current of the charging roller by an atomic force microscope (AFM).

A surface shape of the charging member and whether or not domains exist at bottom portions of respective concave portions were confirmed using an atomic force microscope (AFM) (Easy Scan 2, Nanosurf Co.), and it is possible to use measured values measured in a spreading resistance mode using the AFM (Easy Scan 2, Nanosurf Co.) as current values of the domains and a matrix. In FIG. 4, a configuration diagram of an electro-conductivity measuring apparatus is shown. A DC power supply (PL-650-0.1, manufactured by Matsusada Precision Co., Ltd.) 44 was connected to an electro-conductive substrate of a charging roller 41 to apply 80 V to the electro-conductive substrate of the charging roller 41, and a free end of a cantilever 42 was brought into contact with a surface layer of the charging roller 41 to obtain a current image through an AFM body 43. As measurement conditions, a cantilever was an ANSCM-PC, an operation mode was a spread resistance mode, a measurement environment was atmospheric, a set point was 20 nN, a P-gain was 3000, an I-gain was 600, a D-gain was 0, a tip voltage was 3 V, an image width was 100 μm, and the number of lines was 256.

In advance, a depth of the concave portion and current values of the domains and the matrix were measured while aligning a composition image of a domain-matrix structure obtained by observing an outer surface of the charging member by a scanning electron microscope (SEM) (trade name: S-3700N, manufactured by Hitachi High-technologies Corporation) and a shape image and a current image of AFM measurement with each other. Measurement conditions of the composition image by the SEM are not particularly limited as long as they can be adjusted so as to obtain a clear image, and as the measurement conditions, a vacuum degree can be high, a signal can be a BSE (COMPO), an acceleration voltage can be 15 kV, and WD can be 5 mm.

Figure 6:
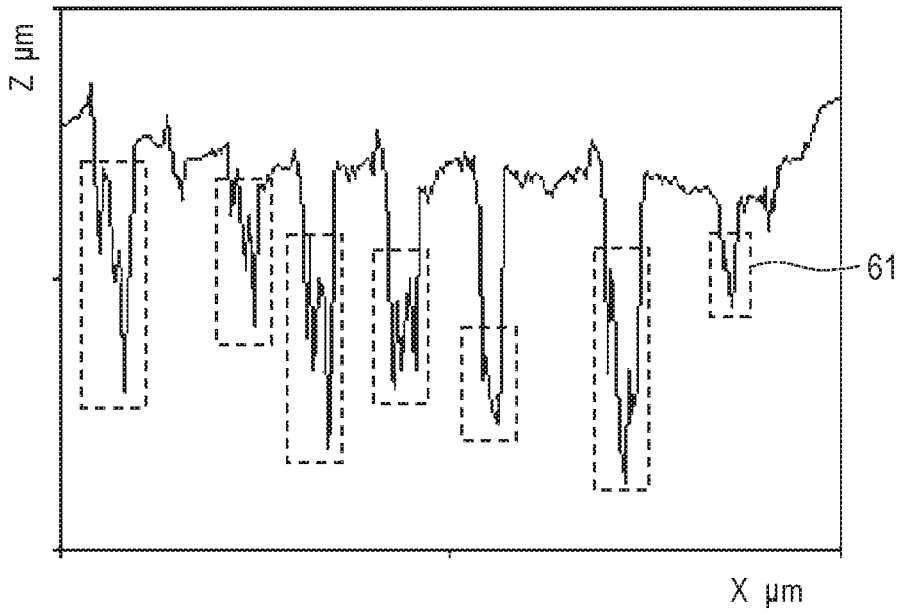
FIG. 6 is a view showing an example of a measurement result of a depth of a concave portion by the AFM.

At the time of this AFM measurement, the shape image and the current image are simultaneously acquired. Portions of the shape image corresponding to the domains of the composition image obtained by the SEM are extracted from the shape image of the AFM. FIG. 6 is a line profile of the shape image of the AFM, and extracted domain portions are denoted by reference numeral 61. A value obtained by subtracting an average value of the domain portions in a height direction Z from an average value of portions other than the domain portions was defined as a depth of the concave portion. The depth of the concave portion was 2.0 μm.

In addition, an average value of current values of the domains extracted at the time of calculating the depth of the concave portion was defined as A2. On the other hand, the portions other than the domain portions were defined as the matrix, and an average value of current values of the matrix was defined as A1. It shows that the larger the A2/A1, the lower the electric resistance of the domains as compared with the matrix. A2/A1 was 97.

(Evaluation of Injection Property of Electric Charge)

Figure 5:
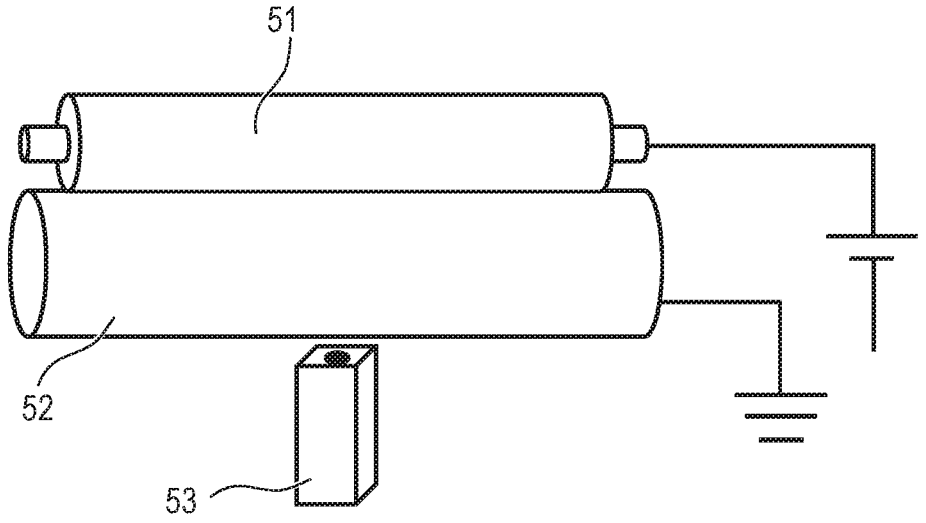
FIG. 5 is a view showing a schematic configuration of an apparatus that measures a surface potential.

The manufactured charging roller was abutted against a member to be charged (OPC drum) of an electrophotographic apparatus (trade name: LBP 7200C, manufactured by Canon Inc., for outputting A4 paper in a longitudinal direction) and was incorporated into a jig (FIG. 5) capable of independently driving the charging roller and the member to be charged, and an injection property of electric charges was evaluated. −500 V was applied to the charging roller 51 under an environment of 30° C./80% RH (relative humidity), and a potential was measured at a rotational speed of a member 52 to be charged of 180 mm/sec and a rotational speed of the charging roller of 200 mm/sec by a surface electrometer 53 (model 370, manufactured by Trek Japan Co., Ltd.). An average value of surface potentials of first rotation of the member to be charged was defined as a potential by injection of electric charges by applying the voltage. The reason why the applied voltage is −500 V is to measure a change in a potential due to the injection of the electric charges without almost generating charging by discharge.

Examples 2 to 13

<Preparation of CMB 2 to CMB 13>

CMB 2 to CMB 13 were prepared in the same manner as a manner of preparing the CMB 1 except that materials listed in Table 4 were used in compounding amounts shown in Table 4. In addition, die swell values were calculated in the same manner as that the CMB1.

TABLE 4

| Material | | CMB | | | | | | | | | | | |
|---|---|---|---|---|---|---|---|---|---|---|---|---|---|
| | (Trade Name, Manufacturer) | 2 | 3 | 4 | 5 | 6 | 7 | 8 | 9 | 10 | 11 | 12 | 13 |
| Raw Material Group 1 | SBR (Tufdene 2003, manufactured by Asahi Chemical Industry Co.) | 4 | 8 | 19 | 15 | 10.5 | 13.3 | 19 | 4 | | 1 | 25 | 16.8 |
| | NBR (N230SL, manufactured by JSR Co.) | | | | | | | | | 15 | | | |
| | Liquid-state SBR (L-SBR-820, manufactured by Kuraray Co.) | | | | | 4.5 | 5.7 | | | | | | 7.2 |
| | Carbon Black (Tokai Black #5500, manufactured by Tokai Carbon Co., Ltd.) | 3.2 | 6.4 | 15.2 | 9 | 9 | 15.2 | 15.2 | 3.2 | 13.5 | 0.8 | 20 | 9.6 |
| | Zinc Oxide | 0.2 | 0.4 | 0.95 | 0.75 | 0.75 | 0.95 | 0.95 | 0.2 | 0.75 | 0.05 | 1.25 | 1.2 |
| | Zinc Stearate | 0.04 | 0.08 | 0.19 | 0.15 | 0.15 | 0.19 | 0.19 | 0.04 | 0.15 | 0.01 | 0.25 | 0.24 |

Unit of compounding amount: part

<Calculation of Die Swell Values of Raw Materials 2 to 13 for Forming A Kneaded Rubber Composition>

Die swell values of raw materials for forming A kneaded rubber compositions were calculated in the same manner as that of Example 1 except that materials listed in Table 5 were used in compounding amounts listed in Table 5.

TABLE 5

| | Raw Material for Forming A Kneaded Rubber Composition | | | | | | | | | | | |
|---|---|---|---|---|---|---|---|---|---|---|---|---|
| | 2 | 3 | 4 | 5 | 6 | 7 | 8 | 9 | 10 | 11 | 12 | 13 |
| NBR (N230SL, manufactured by JSR Co.) | 96 | 92 | 81 | 85 | 85 | 81 | 56.7 | 67.2 | | 99 | 75 | 85 |
| GECO (EpichlomerCG105, manufactured by Osaka Soda Co.) | | | | | | | | | 85 | | | |
| Liquid-state NBR (N280, manufactured by JSR Co.) | | | | | | | 24.3 | 28.8 | | | | |
| Zinc Oxide | 4.8 | 4.6 | 4.05 | 4.25 | 4.25 | 4.05 | 4.05 | 4.8 | 4.25 | 4.95 | 3.75 | 3.8 |
| Zinc Stearate | 0.96 | 0.92 | 0.81 | 0.85 | 0.85 | 0.81 | 0.81 | 0.96 | 0.85 | 0.99 | 0.75 | 0.76 |
| Calcium Carbonate (Super#1700, manufactured by Maruo Calcium Co.) | 24 | 23 | 20.25 | 21.25 | 21.25 | 20.25 | 20.25 | 16.8 | 21.25 | 24.75 | 18.75 | 19 |
| Silica (NipsilVN 3, manufactured by Tosoh Silica Co.) | | | | 21.25 | 21.25 | | | | | | | 19 |
| Ionic Electro-conductive Agent (LV70, manufactured by ADEKA Co.) | 0.5 | | | | | | | 1 | | 1.5 | | |

Unit of compounding amount: part

<Manufacturing of Unvulcanized Rubber Compositions 2 to 13 and Manufacturing of Charging Rollers 2 to 13>

Unvulcanized rubber compositions 2 to 13 were prepared in the same manner as a manner of preparing the unvulcanized rubber composition 1 according to Example 1 except that the CMB 2 to CMB 13 and the raw materials 2 to 13 for forming the A kneaded rubber composition were used.

Charging rollers 2 to 13 were manufactured in the same manner as that of Example 1 except that the unvulcanized rubber compositions 2 to 13 were used, and were then evaluated.

Comparative Examples 1 and 2

<Calculation of Die Swell Values of Raw Materials 14 to 15 for Forming A Kneaded Rubber Composition>

Die swell values of raw materials 14 and 15 for forming A kneaded rubber compositions were calculated in the same manner as that of Example 1 except that materials listed in Table 6 were used in compounding amounts listed in Table 6.

TABLE 6

| Material (Trade Name, Manufacturer) | Raw Material for Forming A Kneaded Rubber Composition 14 | 15 |
|---|---|---|
| NBR (N230SL, manufactured by JSR Co.) | 85 | 85 |
| Zinc Oxide | 4.25 | 4.25 |
| Zinc Stearate | 0.85 | 0.85 |
| Calcium Carbonate (Super#1700, manufactured by Maruo Calcium Co.) | 21.25 | 21.25 |
| Ionic Electro-conductive Agent (LV70, manufactured by ADEKA Co.) | 1 | 2 |

Unit of compounding amount: part

<Preparation of Unvulcanized Rubber Compositions 14 and 15 and Manufacturing of Charging Rollers 14 and 15>

Unvulcanized rubber compositions 14 and 15 were prepared in the same manner as a manner of preparing the unvulcanized rubber composition 5 according to Example 5 except that the raw materials 14 and 15 for forming the A kneaded rubber composition were used. Charging rollers 14 and 15 were manufactured in the same manner as that of Example 1 except that the unvulcanized rubber compositions 14 and 15 were used, and were then evaluated.

Comparative Example 3

In a step of Example 1, a surface of the vulcanized rubber layer of the vulcanized rubber roller after (Molding of Vulcanized Rubber Layer) and before (Irradiation of Electron Beam to Vulcanized Rubber Layer after Extrusion) was polished by a plunge cut polishing-type polishing machine to allow a shape of the vulcanized rubber layer to be a crown shape of which a diameter of an end portion is 8.3 mm and a diameter of a central portion is 8.5 mm. A charging roller 16 was manufactured in the same manner as that of Example 1 except that a step of (Irradiation of Electron Beam to Vulcanized Rubber Layer after Extrusion) in Example 1 was performed after a polishing step, and was then evaluated in the same manner as that of Example 1.

Comparative Example 4

A charging roller 17 was manufactured in the same manner as that of Example 1 except that the vulcanized rubber layer in (Molding of Vulcanized Rubber Layer) in a step of Example 1 was molded by a die rather than the extrusion to allow a shape of the vulcanized rubber layer to be a crown shape of which a diameter of an end portion is 8.5 mm and a diameter of a central portion is 8.6 mm, and was then evaluated in the same manner as that of Example 1.

As molding conditions of the mold, a split die and a press machine were used, a pressure was 10 MPa, a temperature was 160° C., and a time was 40 minutes.

Comparative Example 5

A charging roller 18 was manufactured in the same manner as that of Example 1 except that A kneaded raw materials containing a nitrile butadiene rubber (NBR), a styrene butadiene rubber (SBR), and carbon black are simultaneously kneaded in (Preparation of Unvulcanized Rubber Composition) without performing the (Preparation of Carbon Master Batch) in a step of Example 1, and was then evaluated in the same manner as that of Example 1.

Evaluation results of Examples 1 to 13 and Comparative Examples 1 to 5 are shown in Tables 7 and 8.

TABLE 7

| | Example | | | | | | | | |
|---|---|---|---|---|---|---|---|---|---|
| | 1 | 2 | 3 | 4 | 5 | 6 | 7 | 8 | 9 |
| Charging Roller No. | 1 | 2 | 3 | 4 | 5 | 6 | 7 | 8 | 9 |
| DS(m)/DS(d) | 1.2 | 1.2 | 1.2 | 1.2 | 1.1 | 1.1 | 1.2 | 1.2 | 1.2 |
| Whether or not Domain-Matrix Structure Exists | Exist | Exist | Exist | Exist | Exist | Exist | Exist | Exist | Exist |
| Volume Fraction (Vol %) of Domains | 19.5 | 5.4 | 10.5 | 24.3 | 16.8 | 16.8 | 24.3 | 24.3 | 5.4 |
| Number of Domains (Pieces/1000 $\mu m^3$) | 24 | 4 | 11 | 35 | 168 | 490 | 333 | 12 | 1 |
| Depth (μm) of Concave Portion of Which Bottom Portion is Domain | 2.0 | 2.3 | 2.1 | 1.9 | 1.0 | 0.7 | 0.9 | 2.7 | 3.9 |
| Volume Resistivity (Ωcm) | $4.7 \times 10^5$ | $6.4 \times 10^6$ | $1.2 \times 10^7$ | $2.9 \times 10^5$ | $7.9 \times 10^6$ | $3.2 \times 10^6$ | $1.0 \times 10^5$ | $7.9 \times 10^5$ | $1.1 \times 10^6$ |
| A2/A1 | 97 | 37 | 105 | 87 | 76 | 79 | 152 | 85 | 38 |
| Injection Potential (V) | 1 | 2 | 1 | 3 | 3 | 4 | 4 | 1 | 2 |

TABLE 8

| | Example | | | | Comparative Example | | | | |
|---|---|---|---|---|---|---|---|---|---|
| | 10 | 11 | 12 | 13 | 1 | 2 | 3 | 4 | 5 |
| Charging Roller No. | 10 | 11 | 12 | 13 | 14 | 15 | 16 | 17 | 18 |
| DS(m)/DS(d) | 1.2 | 1.2 | 1.2 | 1.1 | 1.2 | 1.2 | 1.2 | 1.2 | — |
| Whether or not Domain-Matrix Structure Exists | Exist | Exist | Exist | Exist | Exist | Exist | Exist | Exist | Not exist |
| Volume Fraction (Vol %) of Domains | 22.2 | 1.4 | 31.3 | 24.9 | 19.3 | 19.3 | 19.5 | 19.5 | — |
| Number of Domains (Pieces/1000 $\mu m^3$) | 38 | 1 | 64 | 3891 | 24 | 21 | 24 | 24 | — |
| Depth (μm) of Concave Portion of Which Bottom Portion is Domain | 1.8 | 2.4 | 1.7 | 0.4 | 2.0 | 2.1 | 0.0 | 0.0 | 0.0 |
| Volume Resistivity (Ωcm) | $2.3 \times 10^5$ | $9.5 \times 10^7$ | $3.6 \times 10^4$ | $5.2 \times 10^7$ | $2.3 \times 10^6$ | $1.5 \times 10^6$ | $4.7 \times 10^5$ | $2.0 \times 10^5$ | $8.7 \times 10^7$ |
| A2/A1 | 43 | 21 | 121 | 43 | 16 | 8 | 79 | 120 | — |
| Injection Potential (V) | 5 | 9 | 6 | 7 | 22 | 25 | 27 | 32 | 38 |

Example 14

In <Preparation of Unvulcanized Rubber Composition 1> of Example 1, the CMB 1, the raw materials shown in Table 2, and spherical acrylic resin particles (trade name: TechpolymerMBX-20, particle diameter: 20 μm, manufactured by Sekisui Plastics Co.) were added in a compounding amount of 10 parts by mass. A charging roller 19 was manufactured in the same manner as that of Example 1 except for this, and was then evaluated.

Since the spherical acrylic resin particles are crosslinked, the spherical acrylic resin particles are not compatible with the NBR constituting the matrix.

Since the spherical acrylic resin particles have an electrical insulation property, DS(m)/DS(d), the number of domains, and A2/A1 were measured by treating the spherical acrylic resin particles as parts of the matrix having an electrical resistance higher than that of the domains containing the rubber to calculate the volume fraction of the domains.

Example 15

In <Preparation of Unvulcanized Rubber Composition 1> of Example 1, in addition to the CMB 1 and the raw materials shown in Table 2, spherical urethane resin particles (trade name: Art Pearl C-400 transparent, particle diameter: 20 μm, manufactured by Negami Chemical Industry Co.) were added in a compounding amount of 10 parts by mass. A charging roller 21 was manufactured in the same manner as that of Example 1except for this, and was then evaluated.

Since the spherical urethane resin particles are crosslinked, the spherical urethane resin particles are not compatible with the NBR constituting the matrix.

Since the spherical urethane resin particles have an electrical insulation property, DS(m)/DS(d), the number of domains, and A2/A1 were measured by treating the spherical urethane resin particles as parts of the matrix having an electrical resistance higher than that of the domains containing the rubber to calculate the volume fraction of the domains, as in Example 14.

Example 16

In Example 14, irradiation of an electron beam is performed in the same manner as that of Example 1. A charging roller 21 was prepared in the same manner as that of Example 14 except that a process was changed so as to irradiate ultraviolet rays under the following conditions instead of the irradiation of the electron beam, and was then evaluated.

The ultraviolet rays were uniformly irradiated while rotating the charging roller using a low pressure mercury lamp (trade name: GLQ 500US/11, manufactured by Toshiba Lighting & Technology Co.). An amount of ultraviolet rays was set to be 8000 mJ/cm$^2$ at a sensitivity in a sensor of 254 nm.

Example 17

In Example 15, irradiation of an electron beam is performed in the same manner as that of Example 1. A charging roller 22 was prepared in the same manner as that of Example 15 except that a process was changed so as to irradiate ultraviolet rays under the following conditions instead of the irradiation of the electron beam, and was then evaluated.

The ultraviolet rays were uniformly irradiated while rotating the charging roller using a low pressure mercury lamp (trade name: GLQ 500US/11, manufactured by Toshiba Lighting & Technology Co.). An amount of ultraviolet rays was set to be 8000 mJ/cm$^2$ at a sensitivity in a sensor of 254 nm.

Example 18

A spherical polyethylene resin particle master batch PE-MB1 was prepared as follows.

Materials listed in Table 9 were prepared as raw materials. These materials were mixed with each other in the compounding amounts listed in Table 9 to obtain the spherical polyethylene resin particle master batch PE-MB1.

As a mixer, a 6 liter pressure kneader (trade name: TD6-15MDX, manufactured by Tosin Co.) was used. As mixing conditions, a packing factor was 50 vol %, revolutions per minute of a blade were 10 rpm, and a mixing time was 5 minutes. A maximum attainable temperature at the time of mixing the materials with each other was 80° C., which was a value sufficiently lower than 120° C. which is a melting point of polyethylene.

TABLE 9

| Material (Trade Name, Manufacturer) | Compounding Amount (part) |
|---|---|
| Spherical Polyethylene Resin Particles (Mipelon XM-220, Mitsui Chemicals, Co., Ltd.) | 70 |
| NBR (Nipol DL401LL, Zeon Co., Ltd.) | 20 |
| Liquid-state NBR (Nipol1312, Zeon Co., Ltd.) | 10 |

An unvulcanized rubber composition 16 was prepared by adding the spherical polyethylene resin particle master batch PE-MB1 prepared above in a compounding amount of 14.3 parts by mass to the unvulcanized rubber composition 1 prepared in Example 1 and kneading the mixture by an open roll.

A maximum attainable temperature of the unvulcanized rubber composition 16 at the time of the open roll kneading was 92° C.

Since spherical polyethylene resin particles are kneaded at a melting temperature or less, they are not compatible with the NBR of the matrix.

Since the spherical polyethylene resin particles have an electrical insulation property, DS(m)/DS(d), the number of domains, and A2/A1 were measured by treating the spherical polyethylene resin particles as parts of the matrix having an electrical resistance higher than that of the domains containing the rubber to calculate the volume fraction of the domains.

A charging roller 23 was prepared in the same manner as of the Example 1 except that the unvulcanized rubber composition 16 was used instead of the unvulcanized rubber composition 1, and was then evaluated.

Evaluation results of Examples 14 to 18 are shown in Table 10.

TABLE 10

| | Example | | | | |
|---|---|---|---|---|---|
| | 14 | 15 | 16 | 17 | 18 |
| Charging Roller No. | 19 | 20 | 21 | 22 | 23 |
| DS(m)/DS(d) | 1.2 | 1.2 | 1.2 | 1.2 | 1.2 |
| Whether or not Domain-Matrix Structure Exists | Exist | Exist | Exist | Exist | Exist |
| Volume Fraction (Vol %) of Domains | 17.9 | 17.9 | 17.9 | 17.9 | 17.4 |
| Number of Domains (Pieces/1000 μm$^3$) | 22 | 21 | 22 | 21 | 20 |
| Depth (μm) of Concave Portion of Which Bottom Portion is Domain | 1.9 | 2.1 | 2.2 | 2.3 | 2.3 |
| Volume Resistivity (Ωcm) | $4.5 \times 10^5$ | $3.8 \times 10^5$ | $3.9 \times 10^5$ | $4.2 \times 10^5$ | $6.7 \times 10^5$ |
| A2/A1 | 88 | 92 | 96 | 102 | 108 |
| Injection Potential (V) | 1 | 1 | 1 | 1 | 1 |

Among Examples 1 to 18, in the charging members satisfying a certain volume resistivity, as A2/A1 becomes larges, the number of domains becomes small, a volume fraction of the domains becomes small, and concave portions become deeper, an injection potential tended to become low. In Example 10, an ionic electro-conductive hydrin rubber was used, such that movement of electric charges by contact easily occurred as compared with the NBR, and thus, an injection potential was 5 V. In Example 11, since a volume fraction of domains is small, electro-conductivity of a matrix needs to be high, such that movement of electric charges by contact easily occurred, and thus, an injection potential was 9 V. In Example 12, since a volume fraction of domains is large, a distance between the domains becomes small, such that electric field concentration occurred. Therefore, movement of electric charges easily occurred, and thus, an injection potential was 6 V. In Example 13, since the number of domains is large, the domains are connected to each other, such that electric field concentration occurred. Therefore, movement of electric charges easily occurred, and thus, an injection potential was 7 V.

In Comparative Examples 1 and 2, in the charging members satisfying a constant volume resistivity, A2/A1 was small, such that injection potentials were 22 V and 25 V, respectively. In addition, Comparative Example 3 did not have a surface shape in which domains exist only on concave portions due to the molding by the polishing, such that an injection potential was 27 V. Likewise, Comparative Example 4 did not have a surface shape in which domains exist only on concave portions due to the molding by the die, such that an injection potential was 32 V. Comparative Example 5 did not have a domain-matrix structure, such that carbon black uniformly existed in an elastic layer. For this reason, an injection potential was 38 V.

While the present disclosure has been described with reference to exemplary embodiments, it is to be understood that the disclosure is not limited to the disclosed exemplary embodiments. The scope of the following claims is to be accorded the broadest interpretation so as to encompass all such modifications and equivalent structures and functions.

This application claims the benefit of Japanese Patent Application No. 2018-079952, filed Apr. 18, 2018, and Japanese Patent Application No. 2019-032936, filed Feb. 26, 2019, which are hereby incorporated by reference herein in their entirety.

What is claimed is:

1. A charging member comprising:

an electro-conductive support; and an elastic layer, wherein the elastic layer is a surface layer of the charging member, and is constituted by a mono layer, the elastic layer includes domains and a matrix, the domains each containing carbon black and rubber, the matrix containing rubber and having an electrical resistance higher than that of the domains, an outer surface of the charging member is constituted by a surface of the matrix and surfaces of the domains, and the charging member has concave portions on the outer surface, the domains exist at bottom portions of the respective concave portions and are exposed to the outer surface of the charging member only at the bottom portions of the respective concave portions, the elastic layer has a volume resistivity of $1\times10^5$ Ωcm or more and $1\times10^8$ Ωcm or less, and when A1 is defined as a current value at the time of applying a direct current (DC) voltage of 80 V between the electro-conductive support and a cantilever of an atomic force microscope in contact with a surface of the matrix constituting the outer surface of the charging member and A2 is defined as a current value at the time of applying a DC voltage of 80 V between the electro-conductive support and a cantilever of an atomic force microscope in contact with surfaces of the respective domains constituting the outer surface of the charging member, A2 is 20 times or more of A1.

2. The charging member according to claim 1, wherein a volume fraction of the domains is 5 vol % or more and 25 vol % or less based on a volume of the elastic layer.

3. The charging member according to claim 1, wherein the number of domains existing in a piece of cube of 10 μm in the elastic layer is 1 or more and 500 or less.

4. An electrophotographic apparatus comprising:

an electrophotographic photosensitive member; and a charging member disposed to be capable of charging the electrophotographic photosensitive member, wherein the charging member includes:

an electro-conductive support; and an elastic layer, and the elastic layer is a surface layer of the charging member, and is constituted by a mono layer, the elastic layer includes domains and a matrix, the domains each containing carbon black and rubber, the matrix containing rubber and having an electrical resistance higher than that of the domains, an outer surface of the charging member is constituted by a surface of the matrix and surfaces of the domains, and the charging member has concave portions on the outer surface, the domains exist at bottom portions of the respective concave portions and are exposed to the outer surface of the charging member only at the bottom portions of the respective concave portions, the elastic layer has a volume resistivity of $1\times10^5$ Ωcm or more and $1\times10^8$ Ωcm or less, and when A1 is defined as a current value at the time of applying a direct current (DC) voltage of 80 V between the electro-conductive support and a cantilever of an atomic force microscope in contact with a surface of the matrix constituting the outer surface of the charging member and A2 is defined as a current value at the time of applying a DC voltage of 80 V between the electro-conductive support and a cantilever of an atomic force microscope in contact with surfaces of the respective domains constituting the outer surface of the charging member, A2 is 20 times or more of A1.

5. A process cartridge attachable to and detachable from a body of an electrophotographic apparatus, the process cartridge comprising:

an electrophotographic photosensitive member; and a charging member disposed to be capable of charging the electrophotographic photosensitive member, wherein the charging member includes:

an electro-conductive support; and an elastic layer, and the elastic layer is a surface layer of the charging member, and is constituted by a mono layer, the elastic layer includes domains and a matrix, the domains each containing carbon black and rubber, the matrix containing rubber and having an electrical resistance higher than that of the domains, an outer surface of the charging member is constituted by a surface of the matrix and surfaces of the domains, and the charging member has concave portions on the outer surface, the domains exist at bottom portions of the respective concave portions and are exposed to the outer surface of the charging member only at the bottom portions of the respective concave portions, the elastic layer has a volume resistivity of $1\times10^5$ Ωcm or more and $1\times10^8$ Ωcm or less, and when A1 is defined as a current value at the time of applying a direct current (DC) voltage of 80 V between the electro-conductive support and a cantilever of an atomic force microscope in contact with a surface of the matrix constituting the outer surface of the charging member and A2 is defined as a current value at the time of applying a DC voltage of 80 V between the electro-conductive support and a cantilever of an atomic force microscope in contact with surfaces of the respective domains constituting the outer surface of the charging member, A2 is 20 times or more of A1.

6. A manufacturing method of a charging member, the charging member including an electro-conductive support and an elastic layer, the elastic layer being a surface layer of the charging member, being constituted by a mono layer, and including domains and a matrix, the domains each containing carbon black and rubber, the matrix containing rubber and having an electrical resistance higher than that of the domains, an outer surface of the charging member being constituted by surfaces of the matrix and a surface of the domains and having concave portions, and the domains existing at bottom portions of the respective concave portions and being exposed to the outer surface of the charging member only at the bottom portions of the respective concave portions, the manufacturing method of a charging member comprising:

(A) preparing a carbon master batch (CMB) for forming the domains, each containing carbon black and rubber;

(B) kneading the carbon master batch and a rubber composition that becomes the matrix to prepare a rubber composition having a domain-matrix structure; and (C) extruding the rubber composition having the domain-matrix structure together with a mandrel from a cross-head to cover the surrounding of the mandrel with the rubber composition having the domain-matrix structure, wherein when DS(d) is defined as a die swell value of the carbon master batch and DS(m) is defined as a die swell value of the rubber composition that becomes the matrix, a ratio between the die swell values DS(m)/DS(d) is greater than 1.0.

7. The manufacturing method of a charging member according to claim 6, wherein DS(m)/DS(d) is 1.1 or more.

8. The manufacturing method of a charging member according to claim 6, wherein the elastic layer has a volume resistivity of $1\times10^5$ Ωcm or more and $1\times10^8$ Ωcm or less, and when A1 is defined as a current value at the time of applying a DC voltage of 80 V between the electro-conductive support and a cantilever of an atomic force microscope in contact with a surface of the matrix constituting the outer surface of the charging member and A2 is defined as a current value at the time of applying a DC voltage of 80 V between the electro-conductive support and a cantilever of an atomic force microscope in contact with surfaces of the respective domains constituting the outer surface of the charging member, A2 is 20 times or more of A1.

* * * * *